US007215293B2

(12) United States Patent
Chen et al.

(10) Patent No.: US 7,215,293 B2
(45) Date of Patent: May 8, 2007

(54) HIGH-GAIN LOOP ANTENNA

(75) Inventors: An-Chia Chen, Changhua Hsien (TW); Chia-Lun Tang, Miao-Li Hsien (TW)

(73) Assignee: Industrial Technology Research Institute, Hsinchu (TW)

( * ) Notice: Subject to any disclaimer, the term of this patent is extended or adjusted under 35 U.S.C. 154(b) by 28 days.

(21) Appl. No.: 11/222,347

(22) Filed: Sep. 8, 2005

(65) Prior Publication Data

US 2007/0008223 A1 Jan. 11, 2007

(30) Foreign Application Priority Data

Jul. 8, 2005 (TW) ..... 94123212 A

(51) Int. Cl.
*H01Q 11/12* (2006.01)

(52) U.S. Cl. ..... 343/741; 343/745; 343/866

(58) Field of Classification Search ..... 343/700, 343/741, 742, 744, 745, 829, 846, 866, 867
See application file for complete search history.

(56) References Cited

U.S. PATENT DOCUMENTS 4,160,978 A * 7/1979 DuHamel ..... 343/742
5,583,523 A * 12/1996 Wallace, Jr. ..... 343/741
5,767,813 A * 6/1998 Verma et al. ..... 343/744
6,236,368 B1 5/2001 Johson ..... 343/702
6,344,823 B1 2/2002 Deng ..... 343/700
6,469,675 B1 * 10/2002 Jo et al. ..... 343/744
6,525,694 B2 2/2003 Jiang et al. ..... 343/742
6,697,025 B2 2/2004 Koyanagi et al. ..... 343/741
6,724,348 B2 4/2004 Fang ..... 343/702
6,853,341 B1 * 2/2005 Hellgren et al. ..... 343/742
6,995,718 B2 * 2/2006 Fang ..... 343/702

* cited by examiner

*Primary Examiner*—Tho Phan

(57) ABSTRACT

A high gain loop antenna comprises a conductor ground plane, a feeding signal line, a radiation element including two matching sections and a conductor loop, and a dielectric element formed between the conductor ground plane and the radiation element. Both matching sections connect to the feeding signal line and the radiation element for matching the input impedance. The input impedance can be changed by adjusting the distance between the two matching sections or the lengths of the two matching sections. The conductor loop is to activate the operating mode of the antenna when the current component flows through the loop antenna.

12 Claims, 7 Drawing Sheets

HIGH-GAIN LOOP ANTENNA

FIELD OF THE INVENTION

The present invention generally relates to an antenna, and more specifically to a high-gain loop antenna.

BACKGROUND OF THE INVENTION

Along with the cost decrease for establishment of wireless local area network (LAN), there is no computer maker who doesn't try introducing the wireless LAN equipments, for example a wireless net card, into a notebook computer, however a difficult job for antenna design due to the limited space inside the notebook computer.

A U.S. Pat. No. 6,344,823 "Structure of an antenna and method for manufacturing the same" has disclosed a planar inverted F antenna for use in wireless LAN, which is more advantageous than an average single-pole antenna in build-in allocation and convenience for application.

Another U.S. Pat. No. 6,724,348 "Computer with an embedded antenna" has disclosed a planar inverted F antenna for notebook computer by using an LCD as an allocation environment. However, as the radiant gain of a usual planar inverted F antenna is about 2 dBi, the valid transmission range is decreased owing to the space complexity.

A loop antenna is generally applied for high frequency (HF) communication, but rarely used in small communication equipments because of its high input impedance. A U.S. Pat. No. 6,236,368 "Loop antenna assembly for telecommunication devices" has introduced the concept for using loop antenna in small communication equipments, however, in which a defect is that an operating frequency in the range of 0.05–0.3 wavelength is reserved between a loop antenna and a ground plane.

Another U.S. Pat. No. 6,525,694 "High gain printed loop antenna" has disclosed a tip for solving matching problems by means of feeding a web design, however, which is rather overcomplicated in operating two extra loop circuits in parallel, and has a relatively longer reserved distance about 0.11–0.16 times the wavelength of operating frequency.

Yet, another U.S. Pat. No. 6,697,025 "Antenna apparatus" has disclosed an antenna, which can be folded into a rectangle, is placed in a portable receiver element. This antenna is workable near the ground. However, the radiation element must be folded several times, and the antenna must be grounded or a matching element must be adopted, alternatively.

SUMMARY OF THE INVENTION

The present invention provides a high-gain loop antenna. The high-gain loop antenna mainly comprises a conductor ground plane, a feeding signal line, a radiation element, and a dielectric element. The radiation element includes a matching element and a conductor loop. The dielectric element is allocated between the conductor ground plane and the radiation element.

The feeding signal line is provided for feeding signals. The matching element is connected to the feeding signal line and the conductor loop, so as to achieve the resistance impedance between the matching element and the conductor loop. The conductor loop is used to actuate the operation mode of the antenna, when the current flows onto the radiation element. This not only allows that the radiation directivity pattern is maximal on the horizontal plane, but also simplifies the fabrication of the antenna.

The foregoing and other objects, features, aspects and advantages of the present invention will become better understood from a careful reading of a detailed description provided herein below with appropriate reference to the accompanying drawings.

DETAILED DESCRIPTION OF THE PREFERRED EMBODIMENTS

Figure 1A:
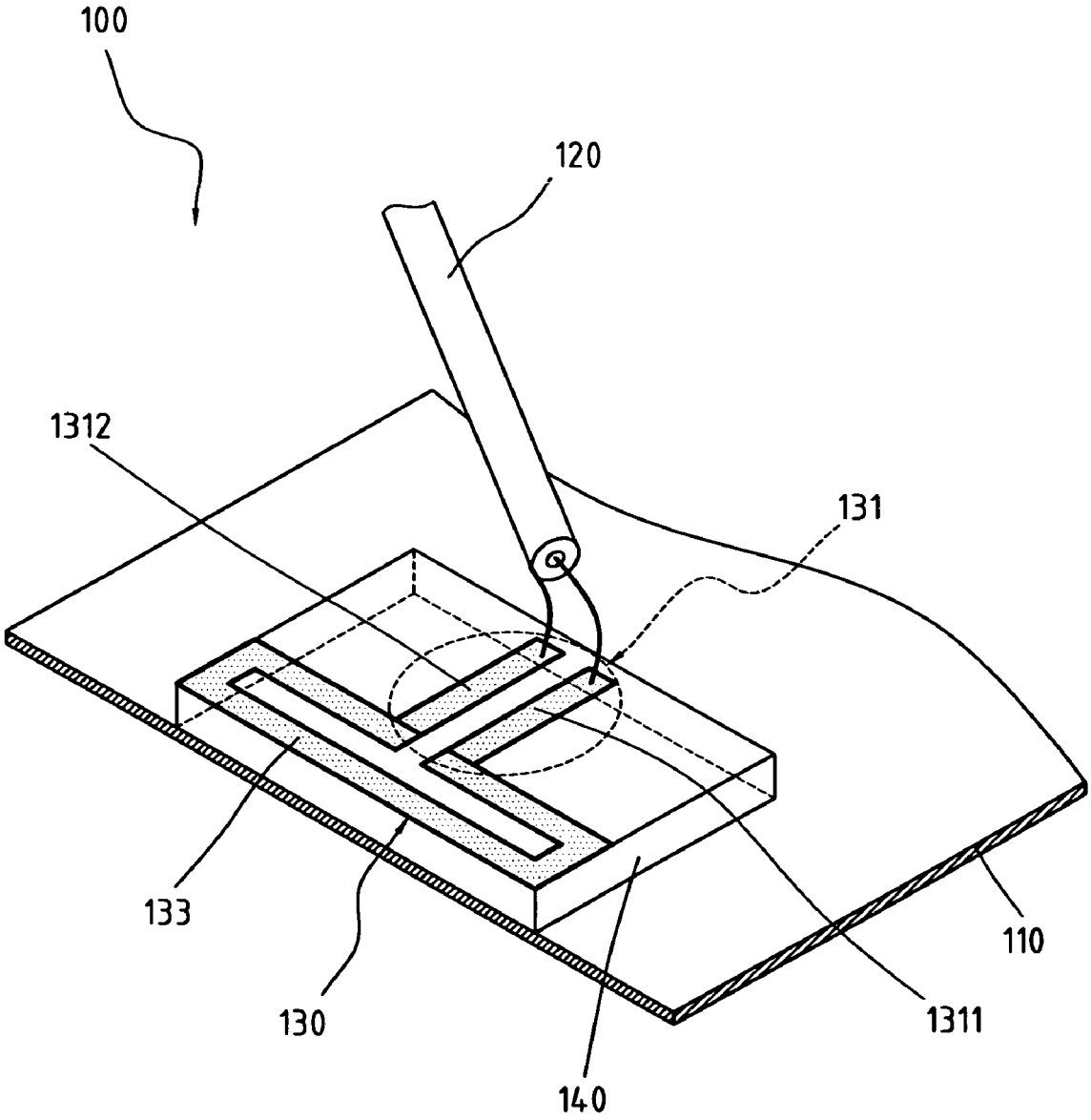
FIG. 1A shows a structural view of a first embodiment of the high-gain loop antenna according to the present invention.
Figure 1B:
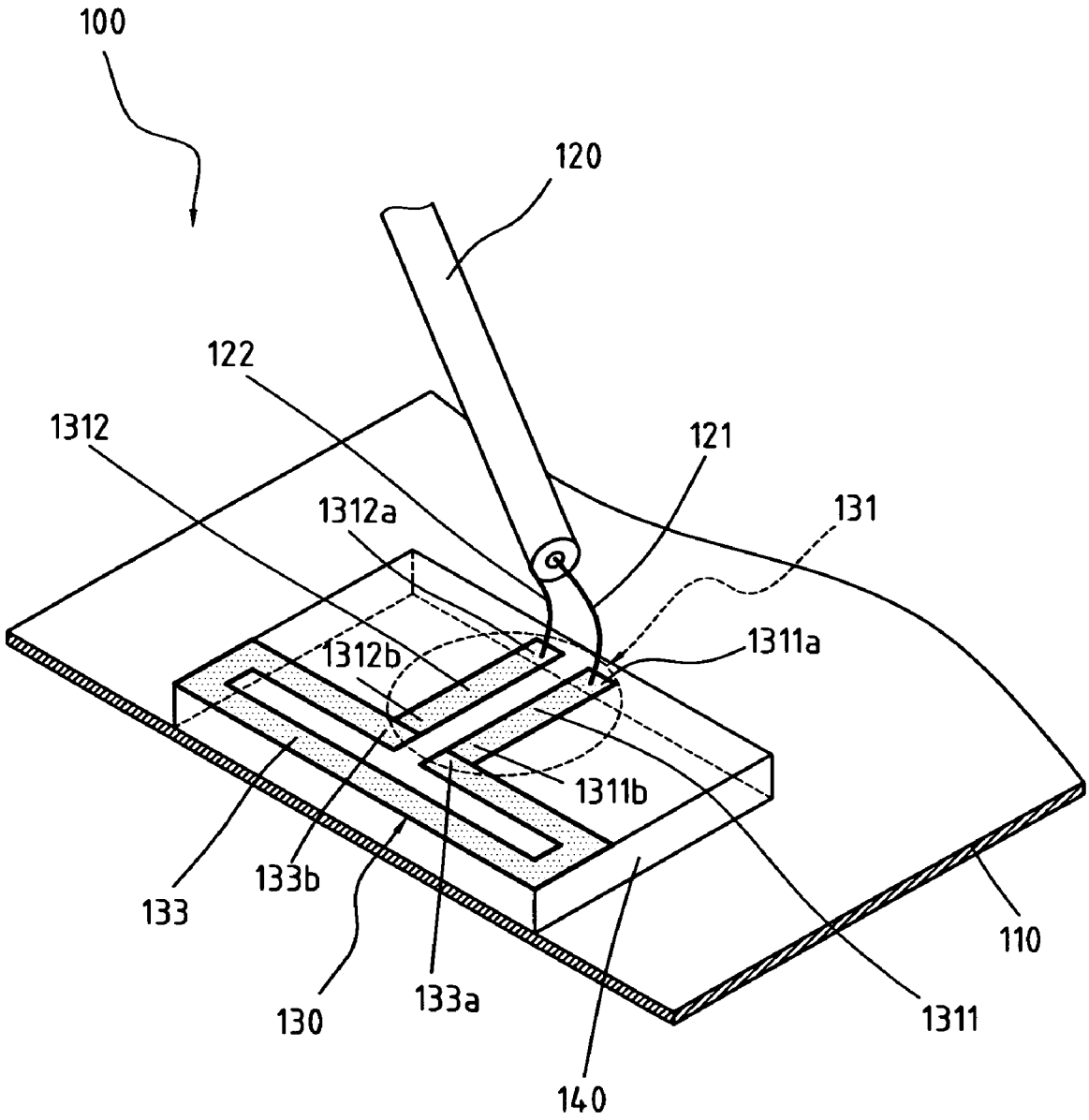
FIG. 1B shows an example of the electrical connection of the elements in the first embodiment of the present invention.

FIG. 1A shows a structural view of a first embodiment of the high-gain loop antenna according to the present invention. Referring to FIG. 1A, the high-gain loop antenna 100 comprises a conductor ground plane 110, a feeding signal line 120, a radiation element 130, and a dielectric element 140. The feeding signal line 120 is provided for feeding signals, including a feeding signal positive end 121 and a feeding signal negative end 122 as shown in FIG. 1B. The radiation element 130 includes a matching element 131 and a conductor loop 133. The matching element 131 includes a first matching section 1311 and a second matching section 1312. The feeding signal line 120 is electrically connected the matching element 131, and the matching element is electrically connected to the conductor loop. The dielectric element 140 is allocated between the conductor ground plane 110 and the radiation element 130.

FIG. 1B shows an example of the electrical connection of the elements in the first embodiment. Referring to FIG. 1B, the feeding signal line 120 has two ends, 121 and 122 respectively. Every matching section has two ends. The first matching section 1311 includes a first end 1311*a* and a second end 1311*b*; similarly, the second matching section 1312 includes a first end 1312*a* and a second end 1312*b*. The first end 1311*a* of the first matching section 1311 is electrically connected to one end 121 of the feeding signal line 120, while the first end 1312*a* of the second matching section 1312 is electrically connected to the other end 122 of the feeding signal line 120.

The conductor loop 133, which functions to actuate the operating mode of antenna while the current flows onto the radiation element, has two ends including a first end 133*a* and a second end 133*b*. The first end 133*a* of the conductor loop is electrically connected to the second end 1311*b* of the first matching section; while the second end 133*b* of the conductor loop is electrically connected to the second end 1312*b* of the second matching section.

The input impedance of the conductor loop 133 may be changed by adjusting the length of the matching element 131 or adjusting the length between the first matching section 1311 and the second matching section 1312 according to this invention, and whereby it is possible to cut down the distance to be reserved between the conductor loop 133 and the conductor ground plane 110 in antenna. For instance, the distance between the conductor loop 133 and the conductor ground plane 110 could be shorter than 0.045 λ (wavelength) of the operating frequency under the condition of a center operating frequency at 2.4 GHz. Besides, the center operating frequency of antenna may be changed by adjusting length of the outer diameter of the conductor loop 133.

From the above mentioned embodiment, this invention is merited as the following. (a) It is able to operate at frequency 2.4 GHz when the height of antenna is shorter than 0.045 λ, and moreover, as no connection to the ground plane is needed, industrial applications are rather convenient. (b) No parallel connection for two loops and two matching elements is necessary for obtaining a low profile of antenna. (c) No extra impedance matching circuit is required, the antenna is thus simple to fabricate.

Figure 2:
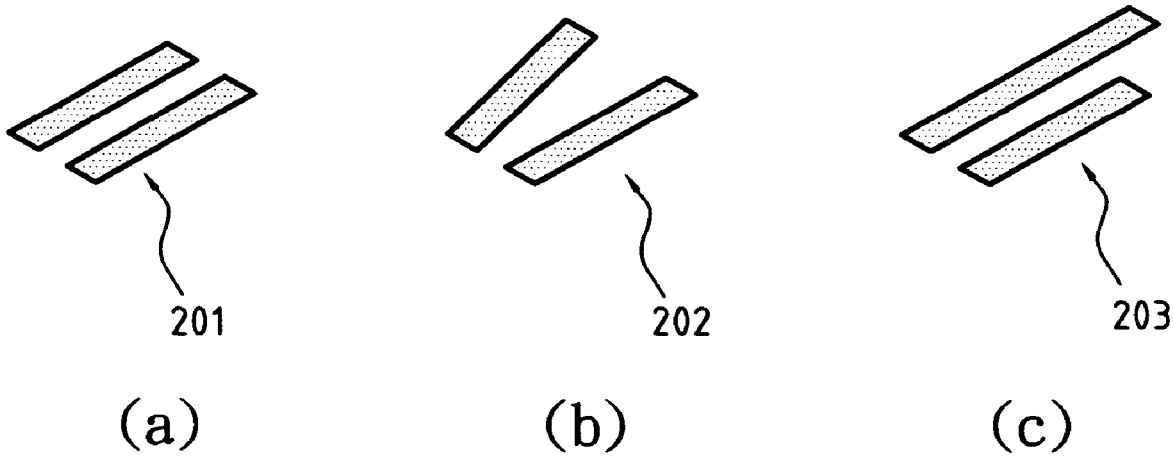
FIGS. 2A–2C are three examples showing the relative space structure of two matching sections of the present invention.

According to this invention, the conductor ground plane may be a screen of a liquid crystal display (LCD) according to this invention. The first and the second matching sections may be parallel or intersected, and the length thereof may be equal or unequal. FIG. 2 shows examples of three possible space structures formed by those two matching sections. FIG. 2*a* shows two matching sections 201 in parallel with equal lengths; FIG. 2*b* shows an included angle smaller than 30° nipped by two matching sections 202; and FIG. 2*c* shows two matching sections 203 in different lengths.

Figure 3:
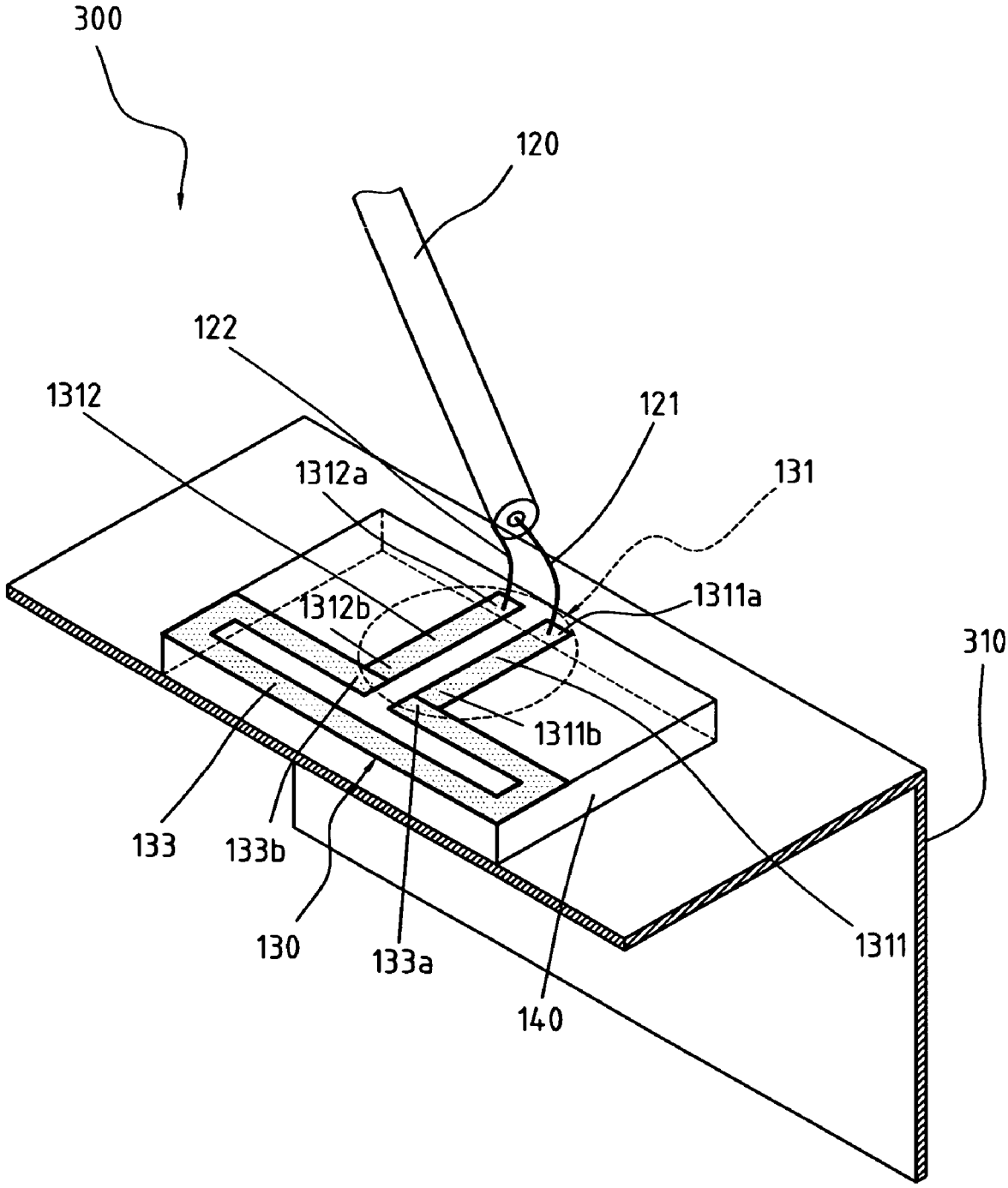
FIG. 3 shows a structural view of a second embodiment of the present invention.

FIG. 3 shows a structural view of a second embodiment of the present invention, in which, different from the first embodiment, a conductor ground plane 310 is bent into an L-shape.

Figure 4:
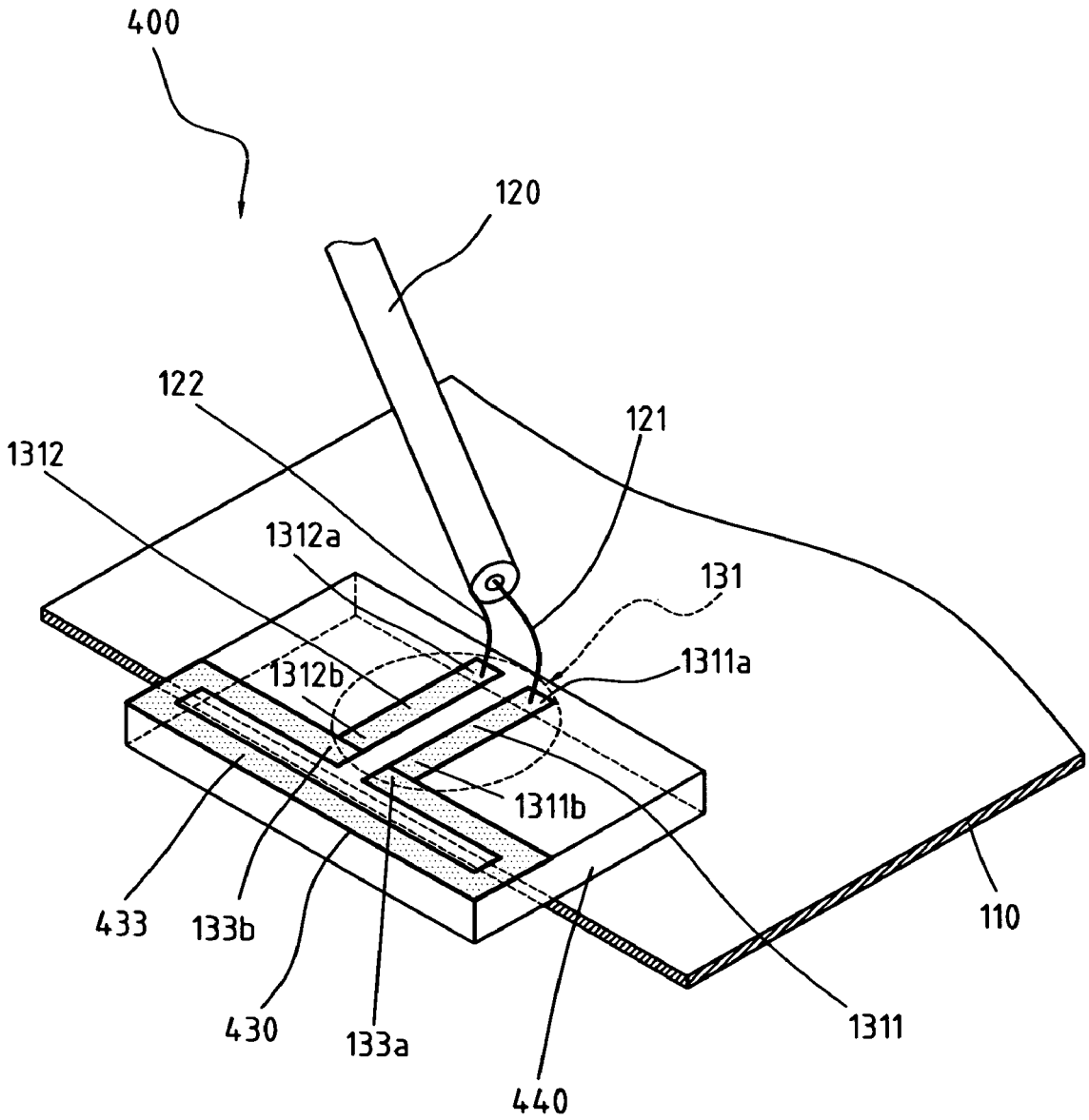
FIG. 4 shows that the conductor loop and the dielectric element are protrudent at an edge of the conductor ground plane.
Figure 5:
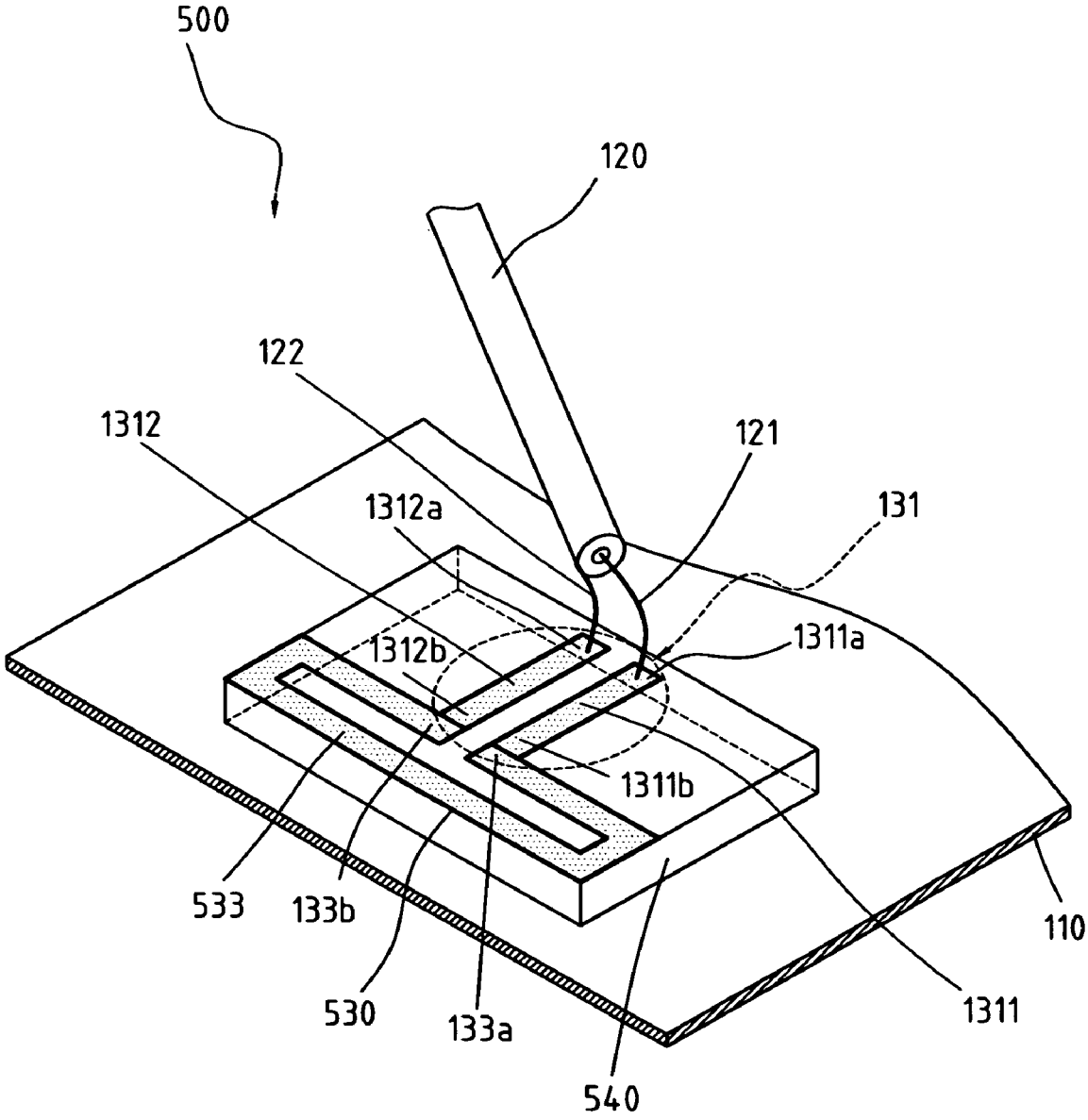
FIG. 5 shows that the conductor loop and the dielectric element are inwardly shrunk at the edge of the conductor ground plane.

In the first embodiment, the conductor loop 133 of the radiation element 130 for the antenna 100 is right at an edge of the conductor ground plane 110. According to the embodiment of this invention, the conductor loop and the dielectric element may be protrudent or inwardly shrunk at an edge of the conductor ground plane, as illustrated in FIG. 4 and FIG. 5 respectively. Referring to FIG. 4, the conductor loop 433 of the radiation element 430 for the antenna 400 is protrudent at an edge of the conductor ground plane 110. Referring to FIG. 5, the conductor loop 533 of the radiation element 530 for the antenna 500 is inwardly shrunk at an edge of the conductor ground plane 110.

Figure 6:
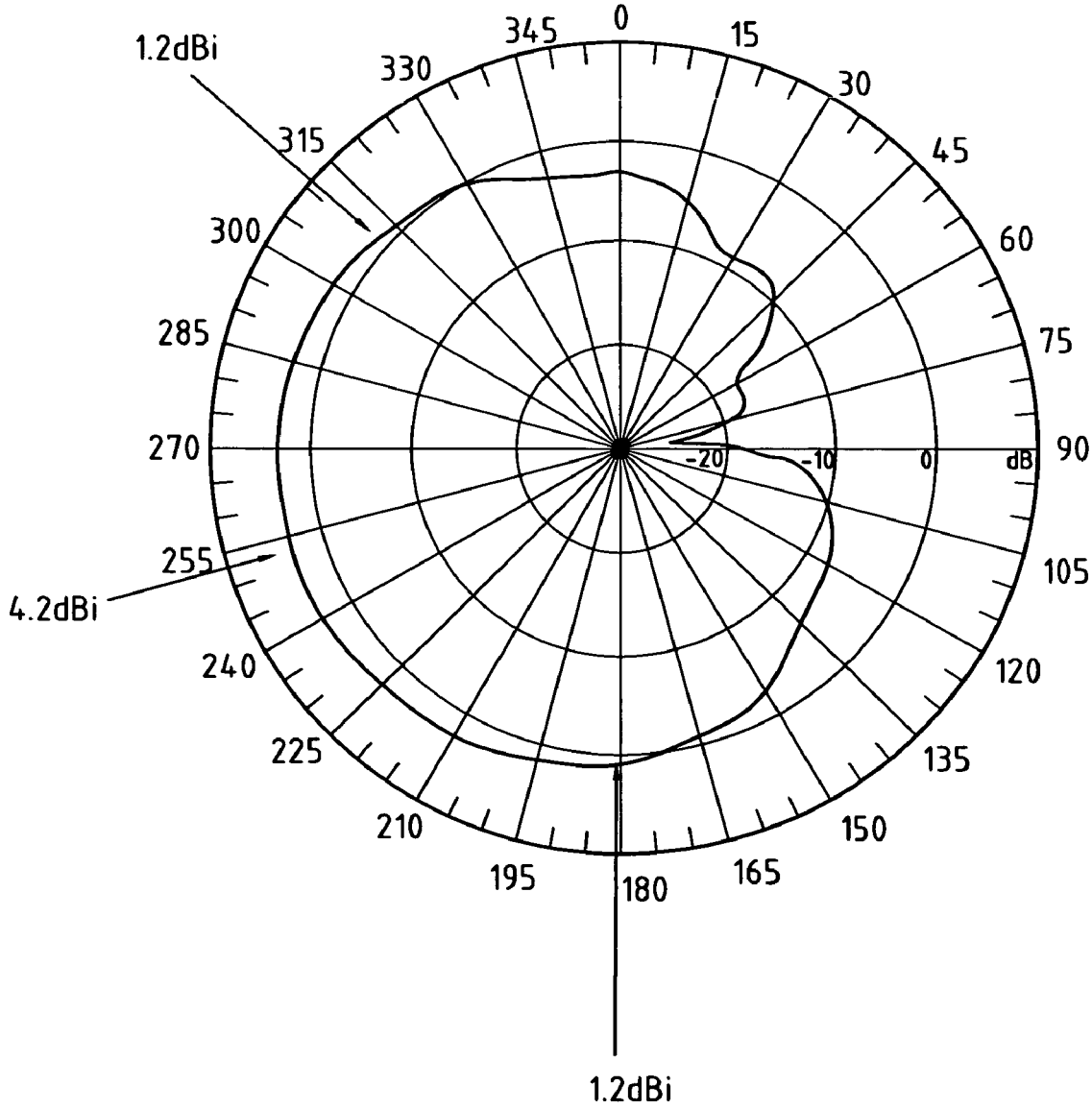
FIG. 6 shows the result of the radiation pattern measurement when the first embodiment of the present invention is operated at 2450 MHz.

FIG. 6 shows the results of the antenna radiation pattern measurement of the first embodiment. Wherein the maximal measurement is 4.2 dBi, as indicated by an arrow, thereby, greatly extending the range for receiving signals. In addition, the angle range for receiving signals can be reached up to 135° (i.e. 180°–315°) for 3 dB beam width (i.e. 1.2 dBi–4.2 dBi), as shown in the FIG. 6.

The radiating element in the embodiment of the invention can be fabricated by using a metal-cutting technique or a conductor-formation process on a printed or flexible circuit board. In conclusion, the reserved distance between the radiating element and the conductor ground plane is short. Thereby, it is applicable to small-size communication devices.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A high-gain loop antenna, comprising:

a conductor ground plane;

a feeding signal line;

a radiation element including a matching element and a conductor loop, and said matching element including a first matching section and a second matching section, said matching element being disposed between said feeding signal line and said conductor loop with one end electrically connected to said feeding signal line and the other end electrically connected to said conductor loop; and a dielectric element located between said conductor ground plane and said radiation element;

wherein said radiation element has no connection to said conductor ground plane.

2. A high-gain loop antenna comprising:

a conductor ground plane;

a feeding signal line;

a radiation element including a matching element and a conductor loop, said matching element including a first matching section and a second matching section, said feeding signal being electrically connected to said matching element which is electrically connected to said conductor loop; and a dielectric element located between said conductor ground plane and said radiation element;

wherein each of said first matching section, said second matching section, said conductor loop and said feeding signal line has two ends, one end of said first matching section is electrically connected to one end of said feeding signal line, one end of said second matching section is electrically connected to the other end of said feeding signal line, one end of said conductor loop is electrically connected to the other end of said first matching section, and the other end of said conductor loop is electrically connected to the other end of said second matching section.

3. The high-gain loop antenna as claimed in claim 2, wherein said conductor ground plane is bent into an L-shape.

4. The high-gain loop antenna as claimed in claim 2, wherein said conductor loop of said radiation element is right at an edge of said conductor ground plane.

5. The high-gain loop antenna as claimed in claim 2, wherein said conductor loop of said radiation element is protrudent at an edge of said conductor ground plane.

6. The high-gain loop antenna as claimed in claim 2, wherein said conductor loop of said radiation element is inwardly shrunk at an edge of said conductor ground plane.

7. The high-gain loop antenna as claimed in claim 2, wherein said first and said second matching sections are parallel with each other.

8. The high-gain loop antenna as claimed in claim 2, wherein the inclined angle between said first and said second matching sections is less than 30°.

9. The high-gain loop antenna as claimed in claim 2, wherein the lengths of said first and said second matching sections are unequal.

10. The high-gain loop antenna as claimed in claim 2, wherein said first and said second matching sections have the same length.

11. The high-gain loop antenna as claimed in claim 2, wherein the distance between the said conductor loop and said conductor ground plane is shorter than 0.045 wavelength of the operating frequency of said loop antenna.

12. The high-gain loop antenna as claimed in claim 2, wherein said conductor ground plane is a display screen of liquid crystal.

* * * * *